United States Patent [19]

Maximov et al.

[11] Patent Number: 4,623,402

[45] Date of Patent: Nov. 18, 1986

[54] METAL COMPOSITION AND PROCESS FOR PRODUCING SAME

[75] Inventors: Jury M. Maximov; Mansur K. Ziatdinov; Anatoly D. Kolmakov; Larisa G. Raskolenko, all of Tomsk; Alexandr G. Merzhanov; Inna P. Borovinskaya, both of Moskovskaya; Fedor I. Dubovitsky, Moscow, all of U.S.S.R.

[73] Assignees: Nauchno-Issledovatelsky Institut Prikladnoi Matematiki Pri Tomskom Gosudarstvennov Universitete, Tomsk; Institut Khimicheskoi Fiziki Akademii Nauk SSSR, Moskovskaya, both of Japan

[21] Appl. No.: 563,552

[22] PCT Filed: Dec. 25, 1980

[86] PCT No.: PCT/SU80/00217

§ 371 Date: Sep. 21, 1981

§ 102(e) Date: Sep. 21, 1981

[87] PCT Pub. No.: WO81/02168

PCT Pub. Date: Aug. 6, 1981

Related U.S. Application Data

[63] Continuation of Ser. No. 305,633, Sep. 21, 1981, abandoned.

[30] Foreign Application Priority Data

Jan. 25, 1980 [SU] U.S.S.R. ..... 2865652

[51] Int. Cl.[4] ..... C21D 1/56

[52] U.S. Cl. ..... 148/20.3; 148/126.1; 420/417; 420/422; 420/424; 420/425; 420/581; 420/129

[58] Field of Search ..... 148/20.3, 31.5, 16.6, 148/126.1; 75/251, 129, 130.5; 420/422, 417, 424, 425, 581

[56] References Cited

U.S. PATENT DOCUMENTS

| | | | |
|---|---|---|---|
| 3,304,175 | 2/1967 | Madsen et al. | 75/134 |
| 3,356,493 | 12/1967 | Danis et al. | 420/581 |
| 3,384,455 | 5/1968 | Fuchs | 75/251 |
| 3,650,729 | 3/1972 | Kindlimann et al. | 148/16.6 |
| 3,726,643 | 4/1973 | Merzhanov et al. | 423/409 |
| 3,857,695 | 12/1974 | Vojkovic | 420/424 |
| 3,998,666 | 12/1976 | Cuddy et al. | 148/16.6 |
| 4,004,891 | 1/1977 | Lin et al. | 75/251 |
| 4,043,839 | 8/1977 | Hartline et al. | 148/20.3 |

FOREIGN PATENT DOCUMENTS

| | | | |
|---|---|---|---|
| 54815 | 3/1967 | Fed. Rep. of Germany . | |
| 1558500 | 11/1970 | Fed. Rep. of Germany . | |
| 25892 | 11/1964 | Japan . | |
| 27321 | 12/1965 | Japan . | |
| 359869 | 3/1969 | Sweden . | |
| 767855 | 2/1957 | United Kingdom | 75/130.5 |
| 584052 | 12/1977 | U.S.S.R. . | |

OTHER PUBLICATIONS

The Condensed Chemical Dictonary, p. 229.

The American Heritage Dictionary of the English Language, pp. 178 and 655.

*Primary Examiner*—John P. Sheehan

*Attorney, Agent, or Firm*—Fleit, Jacobson, Cohn & Price

[57] ABSTRACT

The metal composition and the process for producing same relate to the art of alloy metallurgy.

The metal composition based on metals of VIII Group and nitrides of metals of III-VII Groups is characterized in that at least one alloy containing at least one metal of VIII Group and at least one metal of III-VII Groups are disintegrated to powder, placed into a nitrogen-containing atmosphere with an excess of nitrogen, burning is initiated by way of a local ignition of the mixture at any point thereof and the excess of nitrogen is maintained till completion of the reaction.

The metal composition and process for producing same according to the present invention are useful in the manufacture of hard alloys based on refractory or high-melting compounds.

10 Claims, No Drawings

METAL COMPOSITION AND PROCESS FOR PRODUCING SAME

This application is a continuation of application Ser. No. 305,633, filed Sept. 21, 1981, now abandoned.

FIELD OF THE INVENTION

The present invention relates to metal compositions and processes for producing same.

BACKGROUND OF THE INVENTION

Currently known alloys based on metals of Group VIII and nitrides of metals of Groups III through VII employed as alloying materials have low unsatisfactory properties. Usually these alloys contain 3 to 17% of nitrogen, have density of from 2 to 5 g/cm$^3$, porosity of from 30 to 60%, crushing strength below 2 kg/mm$^2$. These alloys comprise either a powder or a loose sintered briquette. Nitrogen distribution in these alloys is extremely non-uniform. It is usually combined in large-size nitrides with particles of up to 2 mm which are present in the alloy as individual inclusions non-bonded therebetween.

A low density of the above-mentioned alloys, their high porosity and a non-uniform distribution of nitrogen in the form of large-size nitrides cause a low degree of assimilation of nitrogen by steel and a non-uniform distribution thereof within the ingot volume. A low mechanical strength of the alloys and their powder-like state result in considerable losses of the alloy during operations of alloying, transportation and conditioning, as well as in a sharply lowered degree and stability of assimilation of nitrogen by steel.

To produce the above-mentioned alloys, at the present time alloys are obtained which contain metals of Groups III–VII and iron. Usually the starting alloys are disintegrated to powder, placed into the nitrogen-containing atmosphere, heated to a temperature within the range of from 500° to 1,100° C. and maintained at this temperature for several hours.

These prior art processes feature a high rate of electric power consumption, a long duration of the process and a low quality of the resulting alloys. The alloys produced by these processes usually necessitate an additional processing, i.e. briquetting and sintering.

Thus, known in the art is an alloy based on iron and nitrides of manganese and chromium. To produce this material use is made of an alloy of iron with manganese and chromium which is disintegrated to powder with a particle size of below 2 mm and subjected to nitriding for 4 hours at the temperature of 900° C. The content of nitrogen is 4 to 6%. The resulting powder is additionally briquetted (cf. Japanese Pat. No. 27321, Cl. 10 A 12, 1965).

To obtain a higher content of nitrogen in the alloy, a step-wise nitriding process is employed. In accordance with this process, the starting alloy of iron with manganese is ground to powder with a particle size of below 5 mm, heated for 2 to 4 hours to the temperature of 1,000° C.; the resulting sintered mass is again crushed to powder and subjected to nitriding by passing ammonia for 6–10 hours at a temperature within the range of from 500° to 700° C. The thus-produced powder contain 9 to 11% of nitrogen (cf. Swedish Pat. No. 335,235, 1971).

Known in the art is a process for producing alloys based on iron and nitrides of metals of Groups III–VII, wherein the starting alloy containing two metals of III–VII Groups is employed for intensification of the process and a high content of nitrogen. For example, the starting alloy of iron with chromium and aluminium is ground to powder with a particle size of below 60 mm and subjected to nitriding in the atmosphere of nitrogen or ammonia for 5 hours at the temperature 1,000° C. After nitriding the powder contains up to 9.8% of nitrogen (cf. Japanese Pat. No. 25892 Cl. 10N 16, 1964).

Known is another process for producing alloys based on iron and nitrides of metals of Groups III–VII, wherein use is made of the starting alloy incorporating two metals of III–VII Groups. The starting alloy of iron with vanadium and manganese is ground to powder and heated to a temperature within the range of from 900° to 1,100° C. with nitrogen supply for 8 hours without fusing. The resulting powder contains 6 to 17% of nitrogen. Then it is subjected to briquetting using 2 to 10% of a binder (cf. U.S. Pat. No. 3,304,175, 1967).

Known is a process for producing alloys based on iron and nitrides of vanadium, niobium, chromium and manganese. The starting alloys of iron with vanadium, niobium, chromium and manganese are ground to powder with a particle size of below 0.3–0.6 mm and saturated with nitrogen at a temperature of above 800° C. The resulting powder-like alloy contains 3.4 to 11.1% of nitrogen (cf. FRG Pat. No. 1,558,500, 1971).

The above-discussed alloy based on iron and nitrides of metals of III to VII Groups are produced as a powder-like material with an extremely non-uniform distribution of nitrogen.

Known in the art is a process for producing the above-mentioned alloys, wherein for the uniform distribution of nitrogen the process is carried out in rotating tubular furnaces at a temperature within the range of from 700° to 1,100° C. However, in this case the material is also produced as a powder which is hardly suitable for use without additional processing (cf. GDR Pat. No. 54,815, 1967).

The above-listed processes demonstrate that at the present time there is lack of processes resulting in the production of alloys based on metals of Group VIII and nitrides of metals of III–VII Groups with a density of more than 5 g/cm$^3$, porosity below 30%, crushing strength above 5 kg/mm$^2$, relative wear of below 15, nitride particle size of below 0.1 mm at a content of nitrogen of above 5% and uniform distribution of the latter.

There is known a process for producing high-melting inorganic compounds, wherein at least one metal of IV–VI Groups is mixed with one of non-metals selected from the groups of carbon, nitrogen, boron and silicon, oxygen, phosphorus, fluorine chlorine and an ignition agent is introduced into the resulting mixture to create the temperature necessary to initiate burning of the initial components which further interact due to the heat evolved during the reaction (cf. U.S. Pat. No. 3,726,643, 1973).

This process covers the production of powders of refractory inorganic compounds such as nitrides of zirconium, titanium, niobium. The melting point of these nitrides is substantially higher than their burning temperature, i.e. the temperature which is developed in the reaction of interaction between titanium, niobium and zirconium with nitrogen by the above-mentioned process, wherefore it is impossible to obtain a compact material by this process. At best, it is possible to obtain briquettes with a density equal to that of the starting powder (2–4 g/cm$^3$).

It is neither possible to obtain a compact material by the prior art process by introduction of metals of VIII Group into the initial mixture of powders. In this case, due to the formation of local fused regions, the density of the resulting briquettes can be increased to 4.5–5.0 g/cm$^3$, which, however, results in a very non-uniform distribution of nitrogen reaching 50–100%. The fused regions usually alternate with shells and voids, wherefore the crushing strength of the resulting briquettes is very small and does not reach even 5 g/m.

Therefore, the above-mentioned process does not ensure the production of alloys based on metals of Group VIII and nitrides of metals of Groups III–VII with a density above 5 g/cm$^3$, porosity below 30%, crushing strength above 5 kg/mm$^2$, relative wear below 15 units (1 unit—relative wear of tungsten carbide), nitride particle size of below 0.1 mm, at a content of nitrogen above 5% and non-uniformity of nitrogen distribution 10% with non-uniformity of nitrogen distribution of below 10% in the case of using the starting metals as individual elements.

DISCLOSURE OF THE INVENTION

The present invention is directed to the provision, by way of the process for the production of high-melting inorganic compounds, of a metal composition which would possess properties substantially different from properties of the prior art alloys and could be used, without additional treatment, for alloying steel and alloys.

This object is accomplished by that in the prior art process for the production of high-melting inorganic compounds according to the present invention use is made, as the starting materials, of alloys incorporating metals of Group VIII and metals of III–VII Groups which are disintegrated to powder, placed in a nitrogen-containing atmosphere with an excess of nitrogen, locally ignited and the excessive amount of nitrogen is maintained till completion of the combustion process; the present invention also stipulates optimal parameters of the pressure of nitrogen, dispersity of the powder, pre-heating and composition of the starting alloys which make it possible to produce metal compositions with a density of from 5.0 to 8.0 g/cm$^3$, porosity of from 1 to 30%, crushing strength of from 5 to 300 kg/mm$^2$, relative wear of from 1.5 to 15 units, content of nitrogen of from 5 to 17%, nitride particle size of below 0.1 mm, non-uniformity of nitrogen distribution within the volume of below 10%.

Thus, a metal composition comprising nickel and nitrides of vanadium and produced according to the present invention has a density of from 5.8 to 6.4 g/cm$^3$, porosity of from 4.5 to 19%, crushing strength of from 18 to 250 kg/mm$^2$, relative wear of from 1.9 to 14, content of nitrogen of from 8.1 to 14.5, nitride particle size of below 0.02 mm, non-uniformity of nitrogen distribution within the composition volume of below 5%.

A known alloy comprising nickel and nitrides of vanadium and produced by the prior art process discussed hereinbefore has a density of from 3.2 to 4.8 g/cm$^3$, porosity of from 34 to 51%, crushing strength below 1 kg/mm$^2$, relative wear above 25 units, content of nitrogen of from 8.9 to 13.8%, size of vanadium nitride particles of up to 0.5 mm, non-uniformity of nitrogen distribution over the composition volume of up to 50%.

A high density of the compact metal composition produced according to the present invention at a low porosity, a high content of nitrogen, uniform distribution of nitrogen over the whole volume of the composition ensure a high, substantially total assimilation of nitrogen in alloying of steel. A high density of the compact metal composition, a low particle size of nitrides and uniform distribution thereof ensures a high thermal conductivity of the composition, its rapid dissolution in steel and uniform distribution of nitrides over the ingot bulk.

A high density of the compact metal composition, low porosity, high mechanical strength and a high wear-resistance eliminate losses of the material during its transportation, conditioning and steel alloying.

A high mechanical strength at a high wear-resistance of the compact metal composition according to the present invention makes it possible to use the composition for the manufacture of wear-resistant parts of machines and mechanisms.

It has been rather unexpected to suppose that replacement of a mixture of powders of metals of VIII Group with powders of metals of III–VII Groups with alloys of these metals would result in the desired effect. The thermal effect of the reaction of nitriding of the alloy is not higher than the thermal effect from nitriding of the mixture, the reaction surface area is not substantially changed and the composition of the starting material as regards individual elements is the same.

However, it turned out that in the use of alloys of metals of VIII Group with metals of III–VII Groups there is provided a maximum uniform distribution of the metal of Group VIII and nitrides of metals of III–VII groups in the composition. This is achieved owing to the fact that in the starting alloys metals of VIII Group are intermixed with metal of III–VII Groups at the atomic level. In the burning zone fine particles of the starting alloy are dispersed during the formation of nitrides of metals of III–VII Groups with evolution of metals of VIII Group which start to melt thereupon. As a result, a thin layer of a solid-liquid mass is formed which consists of solid micrograins of nitrides and microdrops of the liquid metal of VIII Group which is further densified under the effect of surface tension forces. The liquid-suspended (metals of VIII Group) solid particles (nitrides of metals of Groups III–VII) are entrained by the liquid and get densely packed. At the next moment the resulting dense mass gets solidified and the compact metal composition starts to cool.

Therefore, the present invention relates to a metal composition based on nitrides of metals of III–VII Groups which is characterized by that at least one alloy containing at least one metal of Group VIII and at least one metal of III–VII Groups is disintegrated to powder, placed into a nitrogen-containing atmosphere with excess of nitrogen, combustion of the mixture is initiated by way of local ignition and the excess of nitrogen is maintained till completion of the reaction.

As the starting materials use is made mainly of alloys incorporating the following ingredients:

metals of VIII Group: 2 to 70% by weight;

metals of III–VII Groups: 98 to 30% by weight.

It is advisable to use, as the starting materials, the alloys containing iron, nickel and cobalt, preferably iron, as the metals of Group VIII.

As the starting materials use is made of alloys containing, as metals of III–VII Groups, aluminium, titanium, zirconium, vanadium, niobium, tantalum, chromium, molybdenum, tungsten and manganese, preferably aluminium, vanadium, niobium, chromium and manganese, especially vanadium, chromium and manganese, most preferably vanadium.

It is most advisable to use a mixture of two alloys wherefrom at least one contains at least one metal of III–V Groups.

The starting materials for preparing the metal composition according to the present invention should be so composed as to operate under a pressure of from 1 to 1,000 bar, preferably from 1 to 500 bar, especially 1 to 300 bar and most preferably from 2 to 160 bar.

The starting alloys should be preliminarily disintegrated to powder with a particle size of below 0.01–2 mm, especially 0.01–0.6 mm, preferably 0.02–0.3 mm and, most preferably from 0.04 to 0.15 mm.

Powders of the starting alloys shall be preferably compressed or briquetted in advance.

It is preferable to heat the powder to a temperature within the range of from 100° to 700° C. prior to a further treatment.

Finally, powders of the starting alloys are ignited by means of an electric coil, electric spark or electric arc with powders of metals of III–V Groups or a mixture of powders of III–V Groups with oxides of metals of VI–VIII Groups.

In order to carry out the process under the combustion conditions, it is necessary that the starting alloys would contain a sufficiently high amount of metals of III–VII Groups, the interaction of which with nitrogen is accompanied by evolution of heat, i.e. above 50%. However, in certain alloys the content of metals of III–VII Groups can be below 50%. The reduction of their content to 30% is usually permitted in the case of using, as the starting material, a mixture of two or more alloys, or in the use of a preliminary heating of the starting powder, as well as in the case where a metal of III–VII Groups has a high melting point and there is need in lowering the melting point of the alloy containing this metal.

On the other hand, in order to produce a compact densely sintered material, it is necessary that the starting alloys contain a sufficient amount of a metal of VIII Group, which melts during the nitriding stage and creates the required density level of 30 to 70% on the whole. However, there are alloys which even at a concentration of metals below 30% (down to 2%) make it possible to obtain sufficiently dense metal compositions. Such alloys usually contain metals of III–VII Groups having melting points close to the melting point of nitrides produced therefrom (e.g. vanadium nitrides). Such nitrides are partly melted in the combustion zone thus contributing to augmentation of the liquid phase and densification of the product.

According to the present invention as the starting materials use is made of alloys containing, as metals of VIII Group, iron, nickel and cobalt, since the composition is intended mainly for alloying steel and alloys, wherein no elements of Group VIII other than the above-mentioned three elements are employed. Iron, as compared to nickel and cobalt, is used to a far greater extent in a considerably greater number of steels and alloys. Known is a wide range of steels for alloying of which only iron-based alloys are suitable.

In the starting alloys according to the present invention as metals of Groups III–VII use is made of aluminium, titanium, zirconium, vanadium, niobium, tantalum, chromium, molybdenum, tungsten and manganese. Three out of these metals, namely titanium, zirconium and tantalum, are employed for alloying of a limited class of steels and alloys; the former two metals—due to specific properties of their nitrides, the latter—due to rather less studied character thereof. Aluminium and niobium, though having a more extensive use as compared to the previously mentioned three metals, are rather rarely employed either for alloying steel together with nitrogen, since they form therewith exclusively high-melting nitrides, wherefore they are relied upon only in very particular cases.

The most frequent use is enjoyed by alloys based on nitrides of vanadium, chromium and manganese mainly due to the fact that alloys of these metals are widely available and employed substantially in all classes of steels alloyed with nitrogen; alloys on the basis of vanadium nitrides in certain cases are more preferable due to a higher thermal stability thereof.

In addition to the use, as the starting material, of one alloy in certain cases there is the necessity of using mixture of two and more alloys. To alloy steel of a complex composition it is extremely important to obtain a uniform distribution of properties over the entire volume. This is achieved by uniformity of distribution of all the elements incorporated in the metal. This problem can be more easily solved owing to alloying by means of multi-component alloys. It is most advisable to use as the starting materials, mixtures of two alloys provided that at least one of them contains at least one metal from Groups III–V. In this case it is possible to produce a composition of a complex formulation with the most satisfactory density and required uniformity of distribution of nitrides.

Depending on the formulation of the composition produced according to the present invention it is preferable to carry out the local ignition and maintain an excessive amount of nitrogen within a wide range of nitrogen pressure, i.e. from 1 to 1,000 bar; the point of ignition is not a critical factor. The ignition can be effected both on the surface and in the inner part, as well as in two or more points simultaneously. The ignition can be equally successfully effected by means of an electric coil, an electric spark and an electric arc. Any readily-inflammable exothermal compositions can be employed for the purpose of ignition. However, not to contaminate the material with by products, it is most preferable to use, for this purpose, either powders of metals of III–V Groups or mixtures of powders of III–V Groups with oxides of metals of VI–VIII Groups.

To ensure stationary character of nitriding process under burning conditions from the moment of ignition till the completion of combustion, it is required to maintain an excessive amount of nitrogen within the ambient volume. It is a most simple and convenient technique for solving this problem to carry out the process under an overatmospheric pressure. In this case nitrogen is supplied into the reaction zone by way of filtration through a porous medium of the starting powder due to the pressure drop in the working space and the reaction zone, wherein continuous absorption of nitrogen from the alloys takes place.

In general, nitrogen can be supplied into the combustion zone not only by means of keeping an overatmospheric pressure, but also by blowing-in nitrogen through a means ensuring a high flow-rate of blowing.

However, the most suitable for the present invention is to maintain an excessive pressure within the range of from 2 to 160 atm. Under such relatively low pressures the majority of alloys get nitrited without preliminary compression and briquetting. In this case the conditions of filtration into the reaction zone are impaired, wherefore to ensure a stationary character of burning, it is necessary to use higher pressures, in certain cases up to 1,000 bar.

To produce a composition according to the present invention, the powder particle size is a very important factor. Every material has its own optimal size of particles ensuring manufacture of the product with the required characteristics, most frequently within the range of from 0.04 to 0.15 mm. This particle size ensures a sufficiently high surface area for the reaction and enables carrying out of the process under combustion conditions. In certain cases there is the necessity to use powders with a particle size of below 0.02 and even below 0.01 mm. The use of super-fine powder is associated either with a low-exothermicity of the reaction of some alloys, or with the necessity to carry out the process under smaller pressures of nitrogen, or with the necessity of improving sintering conditions and formation of a more dense product.

In a number of cases it is desirable, on the contrary, to use a powder with larger particles—usually in the case of nitriding of a mixture of several alloys. An alloy with a coarser particle size, usually less exothermal, is mixed with an alloy having a smaller particle size, usually more exothermal. In such nitriding the coarser powder contributes to the production of a higher-density product, i.e. acts as a heavy-weight agent.

In the production of the composition according to the present invention in certain cases there occurs the need in a preliminary heating of the starting powder, since some alloys have a low exothermicity and cannot be subjected to nitriding under burning conditions without a preliminary heating. The heating is effected to such temperatures at which the interaction of the starting alloy with nitrogen is still absent. The heating temperature is usually substantially lower than the temperatures maintained in nitriding by conventional methods without the use of combustion.

BEST MODE FOR CARRYING-OUT THE INVENTION

The metal composition from iron and vanadium nitride and production thereof.

As the starting material use is made of an alloy containing iron, vanadium, impurities. This alloy is disintegrated to powder with a particle size of below 0.08 mm. The resulting powder is charged into a container made from siliconized graphite and placed into a sealable reactor. The reactor is filled with nitrogen to the pressure of up to 200 atm. The reaction of interaction of the starting alloy with nitrogen is initiated by means of an electric arc and a weighed portion of titanium powder. As a result of the reaction heat is evolved which is used for a further nitriding in the burning zone moving along the starting alloy. The temperature in the burning zone is equal to 1,470° C., the speed of movement of the burning zone is 0.12 m/sec.

EXAMPLE 1

Metallic composition from nickel and vanadium nitride and production thereof.

As the starting material use is made of an alloy containing 48.31% of nickel, 51.15% of vanadium, 0.54% of impurities. This alloy is disintegrated to powder with a particle size of below 0.2 mm. The resulting powder is charged into a container made from siliconized graphite and placed into a sealable reactor. The reactor is filled with nitrogen to the pressure of up to 100 atm. The reaction of interaction of the starting alloy with nitrogen is initiated by means of a heated tungsten coil and a weighed portion of powders of aluminium and iron oxide. As a result of the reaction heat is evolved which facilitates further nitriding in the combustion zone moving along the starting alloy. The temperature in the burning zone is equal to 1,550° C., the speed of movement of the burning zone is 0.35 cm/sec.

The resulting material comprises a compact metallic composition consisting of nickel and vanadium nitride. The content of nitrogen is 11.50%, density 6.12 g/cm$^3$, porosity 7.6%, crushing strength 112.1 kg/mm$^2$, relative wear 2.99, nitride particle size below 0.01 mm and non-uniformity of nitrogen distribution over the volume of below 4%.

Other examples are given in the following Tables.

The amount of impurities in the thus-produced metal compositions can be as high as 3.5%.

As the impurities use is generally made of aluminium, silicon, carbon, oxygen, sulphur and phosphorus.

TABLE 1

| No. 1 | Starting alloys 2 | Content of metals of Group VIII, % 3 | Content of metals of Groups III–VII, % 4 | Amount of impurities, % 5 | Dispersity of powders, mm, below 6 | Nitrogen pressure, atm 7 | Initial temperature of powders; °C. 8 | Mean of ignition 9 | Ignition material 10 | Temperature, °C. Burning rate, cm/sec 11 | Note 12 |
|---|---|---|---|---|---|---|---|---|---|---|---|
| 1. | Nickel-vanadium | 48.31 | 51.15 | 0.54 | 0.20 | 100 | 20 | tungsten coil | mixture of aluminium and iron oxide | 1,550<br>0.35 | |
| 2. | Iron-vanadium | 58.14 | 40.66 | 1.20 | 0.08 | 200 | 100 | electric arc | titanium | 1,470<br>0.12 | |
| 3. | Iron-vanadium | 44.61 | 54.50 | 0.89 | 0.14 | 1,000 | 20 | electric coil | vanadium | 1,580<br>0.65 | Briquetting |
| 4. | Iron-vanadium | 38.24 | 60.09 | 1.67 | 0.05 | 150 | 20 | electric arc | vanadium | 1,560<br>0.24 | |
| 5. | Iron-vanadium | 18.69 | 80.22 | 1.09 | 0.04 | 1 | 300 | electric coil | vanadium | 1,450<br>0.16 | |
| 6. | Iron-vanadium | 7.21 | 90.29 | 2.50 | 0.10 | 250 | 20 | electric spark | vanadium | 1,720<br>0.70 | |
| 7. | Iron-niobium | 33.64 | 65.88 | 0.48 | 0.05 | 100 | 20 | electric coil | niobium | 1,650<br>0.09 | |
| 8. | Cobalt-titanium | 28.13 | 71.21 | 0.64 | 0.30 | 300 | 20 | electric spark | titanium | 1,770<br>0.25 | Compression |
| 9. | Cobalt-nickel-zirkonium | 14.07<br>14.06 | 70.15 | 1.72 | 0.10 | 120 | 20 | electric coil | zirconium | 1,820<br>0.85 | |
| 10. | Iron-niobium-tantalum | 33.58 | 32.98<br>32.96 | 0.48 | 0.08 | 80 | 20 | electric arc | mixture of aluminium with nickel oxide | 1,620<br>0.14 | |
| 11. | Iron-vanadium, iron-chromium | 44.61 | 54.50 | 0.89 | 0.05 | 500 | 20 | electric coil | niobium | 1,610<br>0.22 | Compression |
| 12. | Iron-aluminium-chromium | 33.64<br>17.73 | 65.88<br>17.69 | 0.48<br>0.57 | 0.05<br>0.10 | 150 | 20 | electric spark | mixture of aluminium with iron oxide | 1,470<br>0.21 | |
| 13. | Iron-vanadium, iron-manganese | 67.70<br>2.0 | 64.01<br>32.21<br>97.64 | 0.09<br>0.36 | 0.04<br>0.10 | 120 | 700 | electric coil | vanadium | 1,420<br>0.15 | |
| 14. | Iron-vanadium, iron-chromium | 18.69<br>28.94 | 80.22<br>70.51 | 1.09<br>0.45 | 0.04<br>0.08 | 200 | 300 | electric coil | vanadium | 1,520<br>0.30 | |
| 15. | Iron-chromium-manganese | 8.87 | 44.92<br>44.94 | 1.27 | 0.01 | 150 | 700 | electric spark | titanium | 1,510<br>0.11 | |
| 16. | Iron-vanadium, iron-tungsten | 18.09<br>44.61 | 80.22<br>54.60 | 1.09<br>0.79 | 0.04<br>2.00 | 120 | 20 | electric coil | vanadium | 1,580<br>0.28 | |
| 17. | Iron-vanadium, iron-manganese, iron-chromium | 2.00<br>28.94 | 97.64<br>70.51 | 0.36<br>0.45 | 0.10<br>0.08 | 150 | 20 | electric arc | vanadium | 1,510<br>0.13 | |
| 18. | Iron-vanadium, iron-molybdenum | 18.69<br>35.12 | 80.22<br>63.14 | 1.09<br>1.74 | 0.04<br>1.00 | 300 | 20 | electric coil | vanadium | 1,550<br>0.20 | |

TABLE 2

| No. 1 | Nitrogen content, % 2 | Density, g/cm³ 3 | Porosity, % 4 | Crushing strength, kg/mm² 5 | Relative wear 6 | Particle size of nitrides, mm 7 | Non-uniformity of nitrogen distribution 8 | Note 9 |
|---|---|---|---|---|---|---|---|---|
| 1 | 11.50 | 6.12 | 7.6 | 112.1 | 2.9 | 0.01 | 4 | |
| 2 | 8.64 | 6.52 | 1.0 | 300.0 | 1.5 | 0.005 | 3 | |
| 3 | 10.72 | 6.29 | 2.9 | 91.4 | 1.9 | 0.008 | 5 | |
| 4 | 12.11 | 5.84 | 12.1 | 15.2 | 8.4 | 0.02 | 5 | |
| 5 | 16.11 | 5.29 | 15.12 | 7.9 | 9.5 | 0.03 | 7 | |
| 6 | 17.00 | 5.21 | 18.14 | 10.1 | 7.7 | 0.02 | 6 | |
| 7 | 6.54 | 7.12 | 21.13 | 12.1 | 8.9 | 0.01 | 10 | |
| 8 | 11.51 | 5.00 | 15.1 | 7.4 | 15.0 | 0.10 | 9 | |
| 9 | 7.40 | 7.51 | 10.4 | 21.1 | 5.9 | 0.05 | 6 | |
| 10 | 5.00 | 8.00 | 18.9 | 11.9 | 4.8 | 0.02 | 8 | |
| 11 | 8.63 | 6.59 | 9.1 | 39.1 | 4.9 | 0.008 | 5 | |
| 12 | 14.53 | 6.11 | 24.3 | 6.12 | 12.4 | 0.08 | 6 | |
| 13 | 9.91 | 5.61 | 15.4 | 19.4 | 11.9 | 0.02 | 4 | |
| 14 | 13.13 | 5.94 | 12.1 | 33.4 | 8.5 | 0.01 | 7 | |
| 15 | 7.6 | 5.12 | 30.0 | 5.1 | 14.8 | 0.08 | 9 | |
| 16 | 12.1 | 8.00 | 20.4 | 12.7 | 4.1 | 0.1 | 4 | |
| 17 | 11.2 | 5.44 | 18.9 | 15.9 | 8.3 | 0.04 | 6 | |
| 18 | 9.4 | 6.91 | 22.4 | 41.1 | 7.4 | 0.06 | 5 | |

INDUSTRIAL APPLICABILITY

The composition and the process for producing the same according to the present invention can be used in the manufacture of hard alloys based on refractory or high-melting compounds.

I claim:

1. A process for producing a metal composition from a starting material consisting essentially of at least one alloy, each said alloy consisting essentially of from 30 to 70% by weight of one or two metals selected from the group consisting of iron, nickel and cobalt, and one, two or three metals selected from the group consisting of aluminum, titanium, zirconium, niobium, tantalum, chromium, molybdenum, tungsten, manganese and vanadium, said process comprising:

a. pulverizing said starting material to a powder having a particle size of 0.01 to 2.0 mm;

b. placing said powder in an atmosphere containing an excess of nitrogen, said atmosphere being maintained at a pressure of from 1 to 1000 bar;

c. locally igniting the powder by means of an electric coil, electric spark or electric arc to produce combustion, wherein combustion is ignited at any point of the powder mass to produce a combustion zone, which combustion zone moves along the powder mass and has a temperature sufficient to melt said one or two metals selected from said first group as the metals of said first group are evolved during the formation of nitrides of said one, two, or three metals of said second group and ranges from 1420°-1820° C., and wherein an excess of nitrogen is maintained until completion of the combustion to thereby produce said metal composition.

2. A process according to claim 1, wherein the starting material is a mixture of two alloys, wherein at least one alloy contains at least one metal from the group consisting of Al, Ti, Zr, V, Nb and Ta.

3. A process according to claim 1, wherein an excess of nitrogen is maintained under a pressure of from 1 to 500 bar.

4. A process according to claim 3, wherein an excess of nitrogen is maintained under a pressure of from 1 to 300 bar.

5. A process according to claim 4, wherein an excess of nitrogen is maintained under a pressure of from 2 to 160 bar.

6. A process according to claim 1, wherein the starting materials are pulverized to a powder with a particle size of from 0.01 to 0.6 mm.

7. A process according to claim 6, wherein the starting materials are pulverized to a powder with a particle size of from 0.02 to 0.3 mm.

8. A process according to claim 6, wherein the starting materials are pulverized to a powder with a particle size of from 0.04 to 0.15 mm.

9. A process according to claim 1, wherein the starting materials are briquetted prior to being placed in said atmosphere.

10. A process according to claim 1, including the further step of preheating said powder to a temperature of from 100 to 700° C., prior to the step of locally igniting the powder.

* * * * *